United States Patent [19]

Taguchi

[11] 4,413,576

[45] Nov. 8, 1983

[54] BUTTONHOLE DEVICE FOR A ZIG-ZAG SEWING MACHINE

[75] Inventor: Kazufumi Taguchi, Kariya, Japan

[73] Assignee: Aisin Seiki Kabushiki Kaisha, Kariya, Japan

[21] Appl. No.: 250,080

[22] Filed: Apr. 1, 1981

[30] Foreign Application Priority Data

Apr. 3, 1980 [JP] Japan ..... 55-43741

[51] Int. Cl.[3] ..... D05B 3/06

[52] U.S. Cl. ..... 112/158 B

[58] Field of Search ..... 112/158 B

[56] References Cited

U.S. PATENT DOCUMENTS

| | | | |
|---|---|---|---|
| 3,148,645 | 9/1964 | Aiki et al. . | |
| 3,149,591 | 9/1964 | Aiki et al. . | |
| 4,084,524 | 4/1978 | Hasegawa | 112/158 B |
| 4,106,418 | 8/1978 | Hayashi | 112/158 B |

*Primary Examiner*—Werner H. Schroeder
*Assistant Examiner*—Andrew M. Falik
*Attorney, Agent, or Firm*—Oblon, Fisher, Spivak, McClelland & Maier

[57] ABSTRACT

A buttonhole device for a zig-zag sewing machine wherein a rotary shaft is operatively connected to a device for controlling lateral needle oscillation, needle position or base line and work feeding, and is positioned at a first position, a second position, a third position, and a fourth position, respectively, for producing one bar tack, one side stitch, the other bar tack and the other side stitch of a buttonhole. The buttonhole is so constructed that an angle between any two adjacent positions of the shaft may be constant. Thus, indica corresponding to the positions of the shaft or four components of the buttonhole may be shown equally spaced circumferentially on a dial connected to the shaft.

7 Claims, 7 Drawing Figures

BUTTONHOLE DEVICE FOR A ZIG-ZAG SEWING MACHINE

BACKGROUND OF THE INVENTION

1. Field of the Invention

This invention relates to a buttonhole device for a zig-zag sewing machine, and more particularly to a two-step buttonhole device wherein one bartack and one side stitch are produced in a first step, and the other bar tack and the other side stitch are produced in a second step.

2. Description of the Prior Art

In a zig-zag sewing machine, rotary shaft is operatively connected to a means by which lateral needle oscillation, needle position or base line and work feed are controlled, so as to produce one bar tack, one side stitch, the other bar tack, and the other side stitch of a buttonhole respectively at a first position, a second position, a third position, and a fourth position of the shaft. In order that the shaft may be automatically rotated from the first position to the second position, may be manually rotated from the second position to the third position, and may be automatically rotated from the third position to the fourth position, a two-step buttonhole device having a ratchet means and a cam means has been provided. However, the conventional two-step buttonhole device has difficulties such as the fact that the device is complex in construction and thepositions of the shaft are out of angular equidistance due to construction of the cam means. Consequently, indica corresponding to the positions of the shaft or four components of the buttonhole may not be shown equally spaced on a dial connected to the shaft.

SUMMARY OF THE INVENTION

It is, therefore, one of the objects of this invention to provide a buttonhole device for a zig-zag sewing machine without the aforementioned difficulties.

BRIEF DESCRIPTION OF THE DRAWINGS

Various other objects, features and attendant advantages of the present invention will be more fully appreciated as the same becomes better understood from the following detailed description when considered in connection with the accompanying drawings wherein.

DETAILED DESCRIPTION OF THE PREFERRED EMBODIMENT

Figure 1:
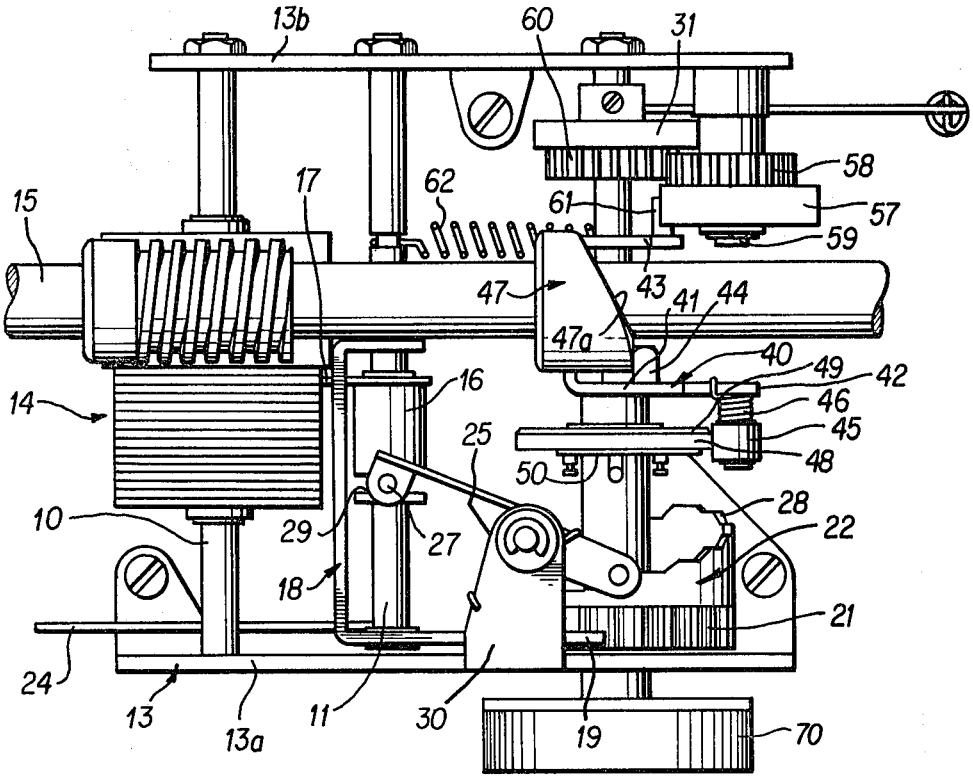
FIG. 1 is a plane view of a buttonhole device and surrounding structure in a zig-zag sewing machine.
Figure 2:
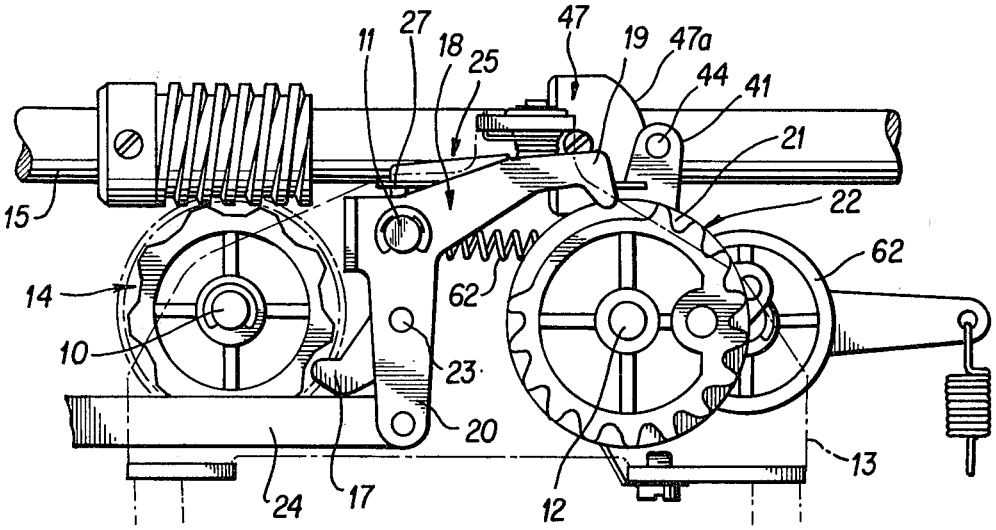
FIG. 2 is a side view of the buttonhole device of FIG. 1 and surrounding structure in a zig-zag sewing machine.
Figure 3:
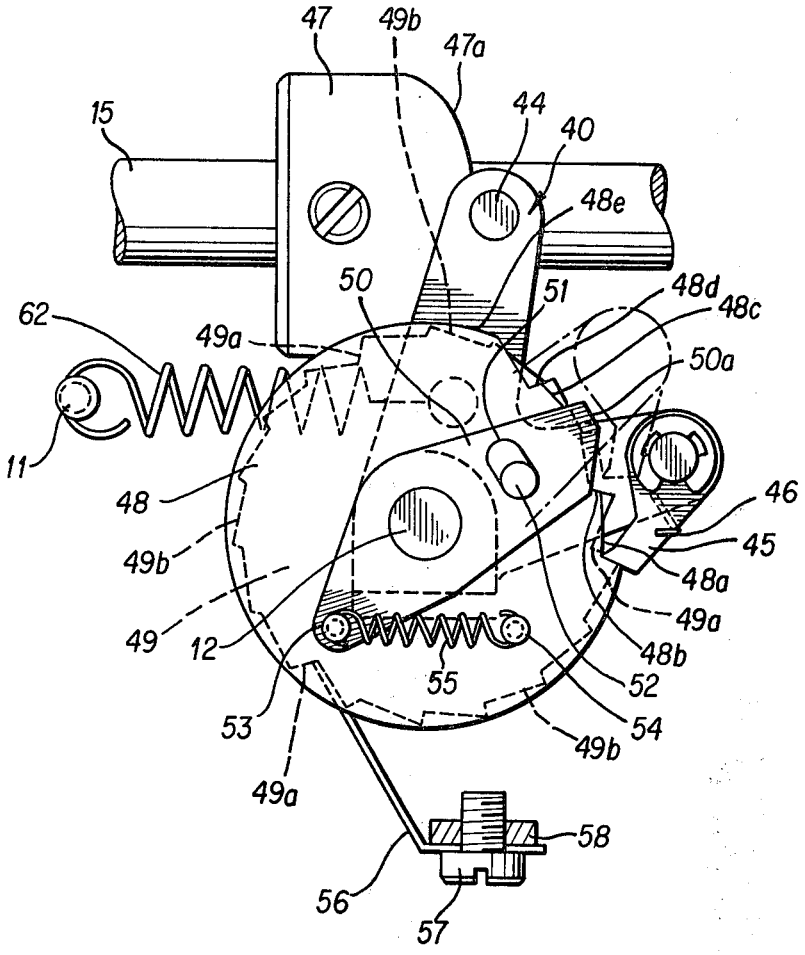
FIG. 3 is an enlarged side view of the buttonhole device.

Referring now to FIGS. 1 through 7, a first shaft 10, a second shaft 11 and a third shaft 12 are rotatably mounted to a frame 13 including a front wall 13*a* and a rear wall 13*b*. A plurality of cams 14 are fixedly mounted on the first shaft 10 which is in meshing engagement with a main shaft 15. A sleeve 16 is slidably mounted on the second shaft 11. A follower 17 is so secured to a rear end portion of the sleeve 16 that the follower 17 may be in engagement with any cam of a plurality of cams 14. An arm 18 is fixedly mounted on the second shaft 11 and includes a follower 19 and a leg 20 disposed at an angle thereto. The follower 19 is in engagement with first cam portion 21 of a cylinder 22 which is fixedly mounted on the third shaft 12. The leg 20 is connected to the follower 17 by a pin 23 and to a needle bar (not shown) via rod 24. An arm 25 having a pair of pins 26 and 27 at opposite ends thereof is pivoted to a bracket 30 secured to the front wall 13*a*. The pin 26 is in engagement with a second cam portion 28 of the cylinder 22. The pin 27 is fitted in a groove 29 formed at front end portion of the sleeve 16. Upon rotation of the third shaft 12 by a dial 70 secured to front end portion thereof, the follower 17 may be disengaged from any cam of the cams 14 and the sleeve 16 may be moved in turn. Thus, lateral needle oscillation and needle position corresponding to a desired pattern are controlled.

A cam 31 is fixedly mounted on the third shaft 12 and is operatively connected to a feed mechanism (not shown). Thus, work feeding is controlled by rotating the third shaft 12. In the aforementioned means for controlling lateral needle oscillation, needle position or base line and work feeding, the third shaft 12 is designed to be positioned at a first position, a second position, a third position, and a fourth position, respectively, for producing one bar tack, one side stitch, the other bar tack, and the other side stitch of a buttonhole. Four indica spaced at equal angles $\theta_1$ corresponding to four components of the buttonhole are represented on the dial 70.

On the third shaft 12 is rotatably mounted an arm 40 having a first portion 41, a second portion 41, and a third portion 43. The first portion 41 and the second portion 42 disposed at an angle thereto are located at front side and the third portion 43 is located at the rear side. The first portion 41 is provided with a pin 44 and the second portion 42 is provided with a pivotable pawl 45. The pawl 45 is urged in a clockwise direction by a spring 46. The pin 44 is continually in engagement with a cam surface 47*a* of a cylindrical cam member 47 fixedly mounted on the main shaft 15 so that the second portion 42 may be reciprocably moved about the third shaft 12 in synchronization with rotation of the main shaft 15. A disc cam 48 is fixedly mounted on the third shaft 12 and is provided with a first surface portion 48*a*, a first recessed portion 48*b*, a second surface portion 48*c*, a second recessed portion 48*d*, and a third surface portion 48*e*.

A ratchet wheel 49 is rotatably mounted on the third shaft 12 and located at a rear side of the disc cam 48. The ratchet wheel 49 is provided at the periphery of the disc cam 48 and has at least three, deep, and equidistantly spaced teeth 49*a*. Between any two adjacent teeth 49*a* there are five, shallow equidistantly spaced teeth 49*b*. The teeth 49*a* are identical to the recessed portions 48*b* and 48*d* of the disc cam 48 in depth. The radius of the teeth 48*b* is slightly larger than that of the first and second surface portions 48*a* and 48*c* of the disc cam 48. The ratchet wheel 49 is so designed that it may be advanced in a clockwise direction by one tooth 49*a* or 49*b* by reciprocal movement of the pawl 45. In detail, when the ratchet wheel 49 is advanced after corresponding positioning of the deep tooth 49*a* with the first recessed portion 48*b*, the third shaft 12 may be automatically rotated from the first position thereof to the second position thereof. When the ratchet wheel 49 is advanced after corresponding positioning of the next deep tooth 49*a* with the second recessed portion 48*d*, the third shaft 12 may be automatically rotated from the third position thereof to the fourth position thereof.

A control member 50 is rotatably mounted on the third shaft 12 and is so provided so as to not engage the pawl 45 with the tooth 49*a* or the tooth 49*b* of the ratchet wheel 49 while the third shaft 12 is positioned at the second position. The control member 50 is formed with a slot 51 with which a pin 52 mounted on and driven by the disc cam 48 is in sliding engagement. A retainer 53 and a pin 54 are respectively driven by the control member 50 and the disk cam 48. Between the retainer 53 and the pin 54, a spring 55 is disposed so as to rotate the control member 50 in a counterclockwise direction. In order to prevent counterclockwise rotation of the ratchet wheel 49, a leaf spring 56 is provided. That is to say, one end portion of the spring 56 is secured to a suitable portion of the frame 13 by a bolt 57 and a nut 58, and the other end of the spring 56 engages with the tooth 49*a* or 49*b*.

Between the second shaft 11 and the third portion 43 of the arm 40, there is disposed a spring 62 as to continually engage the pin 44 with the cam surface 47*a* of the cylindrical cam member 47. In order to disengage the pin 44 from the cam surface 47*a* on the member 47, a releasing cam 57 is provided. The releasing cam 57 and a gear 58 are rigidly secured and are rotatably mounted on a common shaft 59 fixed to the rear wall 14*b*. The gear 58 is in engagement with a gear 60 rigidly secured to the cam 31 on the third shaft 12. The releasing cam 57 is so arranged that it may be brought into engagement with a pin 61 driven to third portion 43 of the arm 40 for pushing the pin 61 downwardly when the dial 29 is rotated for selecting patterns except a buttonhole pattern.

Figure 4:
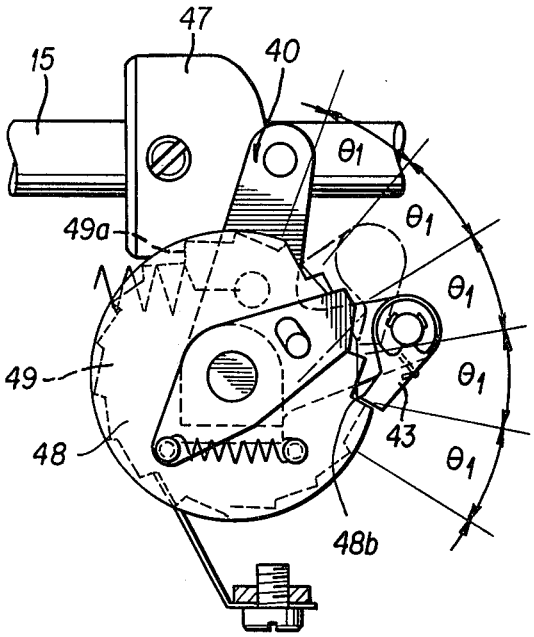
FIGS. 4 through 7 are views representing operation of the buttonhole device.
Figure 5:
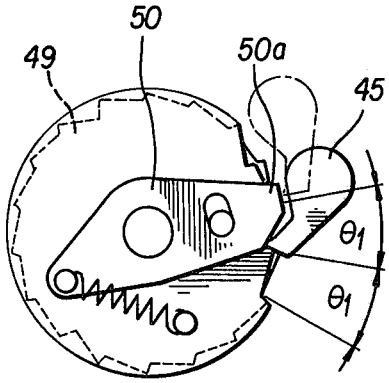

A buttonhole operation is described hereinafter with reference to FIGS. 4 through 7. FIG. 4 shows the position wherein the shaft 12 is positioned at the first position after rotating the dial 70. When the machine is driven in this position, the ratchet wheel 49 only is advanced by the pawl 45 which is in reciprocal movement in synchronization with the main shaft 15. While only the ratchet wheel 49 is advanced, one bar tack of the buttonhole is being produced. Thereafter, the pawl 45 is brought into engagement with the deep tooth 49*a* of the ratchet wheel 49 and the first recessed portion 48*b* of the disc cam 48. When the pawl 45 is further moved, the shaft 12 is automatically rotated from the first position to the second position the ratchet wheel 49 may not be advanced by the pawl 45 because the pawl 45 is in sliding contact with the surface 50*a* of the control member 50. Thus, one side stitch of the buttonhole is produced.

Figure 6:
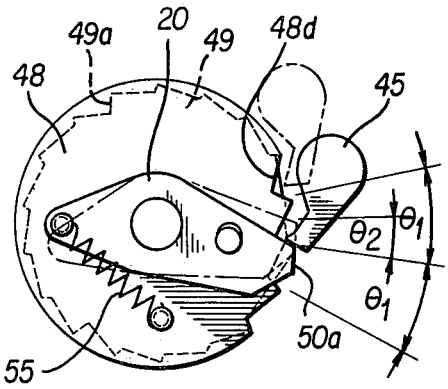
Figure 7:
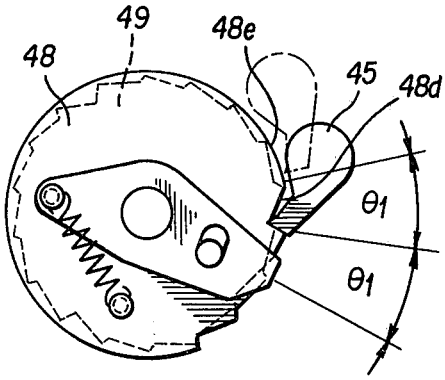

When the shaft 12 is rotated from the second position to the third position under ceasing operation of the machine after completion of one side stitch, the shaft 12 is brought into the position shown in FIG. 6. The other bar tack of the buttonhole is produced while the shaft 12 is positioned at the third position. Meanwhile the pawl 45 is shifted to engage the tooth of the ratchet wheel 49 for advancement thereof with rotation of the control member 50 against the spring 55. Thus, the other bar tack of the buttonhole is produced. Thereafter, the pawl 45 is brought into engagement with next deep tooth 49*a* of the ratchet wheel 49 and the second recessed portion 48*d* of the disc cam 48. When the pawl 45 is moved, the shaft 12 is further automatically rotated from the third position to the fourth position shown in FIG. 7. While the shaft 12 is positioned at the fourth position, the ratchet wheel 49 may not be advanced by the pawl 45 because the pawl 45 is in sliding contact with the third surface portion 48*e* of the disc cam 48. Thus, the other side stitch of the buttonhole is produced. In the Figures, $\theta_1$ denotes an angle between any two adjacent positions of the shaft 12, and $\theta_2$ denotes the rotating angle of the control member 50.

Obviously, numerous modifications and variations of the present invention are possible in light of the above teachings. It is therefore to be understood that

What is claimed is:

1. A buttonhole device for a zig-zag sewing machine comprising:

a main shaft;

a rotary shaft operatively associated with said main shaft;

means operatively connected to said rotary shaft for controlling lateral needle oscillation, needle position or base line and work feeding so as to produce various stitch patterns, and which is positionable at a plurality of positions wherein said plurality of positions further comprise a first position, a second position, a third position and a fourth position respectively corresponding to a first bar tack, a first side stitch, a second bar tack, and a second side stitch of a buttonhole, a disc cam having formed thereon at a peripheral portion thereof a first and second recessed portion and which is fixedly mounted on said rotary shaft, a single ratchet wheel rotatably mounted on the rotary shaft adjacent said disc cam and having a plurality of teeth formed thereon, pawl means reciprocably moved by said main shaft for advancing said ratchet wheel by engaging one of said plurality of teeth of said ratchet wheel to thereby automatically rotate said rotary shaft from said first position to said second position, and for engaging with said second recessed portion of said disc cam to thereby automatically rotate said rotary shaft from said third position to said fourth position, and control means mounted on said rotary shaft for preventing said pawl from engaging with said plurality of teeth of said ratchet wheel while said rotary shaft is positioned at said third position subsequent to being manually rotated from said second position.

2. A buttonhole device in accordance with claim 1 wherein said control means for preventing said pawl means from engaging with said plurality of teeth is rotatably mounted on said rotary shaft so as to be engaged with said pawl means while said rotary shaft is positioned at said third position.

3. A buttonhole device in accordance with claim 2, wherein said disc cam further comprises a pin mounted thereon and driven thereby and wherein said means for preventing said pawl from engaging with said plurality of teeth has a slot formed therein which said pin is slidingly engageable.

4. A buttonhole device in accordance with claim 1, wherein said disc cam further comprises a pin mounted thereon and driven thereby and wherein said means for preventing said pawl from engaging with said plurality of teeth has a slot formed therein within which said pin is slidingly engageable.

5. A buttonhole device in accordance with claim 4, wherein said means for controlling lateral needle oscillation, needle position or base line and work feeding further comprises means for rotating said rotary shaft by equal angles between said first, second, third and fourth positions.

6. A buttonhole device in accordance with claim 1, wherein said means for controlling lateral needle oscillation, needle position or base line and work feeding further comprises means for rotating said rotary shaft by equal angles between said first, second, third and fourth positions.

7. A buttonhole device in accordance with claim 1, wherein said disc cam further comprises a pin mounted thereon and driven thereby and wherein said means for preventing said pawl from engaging with said plurality of teeth has a slot formed therein within which said pin is slidingly engageable and wherein said means for controlling lateral needle oscillation, needle position or base line and work feeding further comprises means for rotating said rotary shaft by equal angles between said first, second, third and fourth positions.

* * * * *

UNITED STATES PATENT AND TRADEMARK OFFICE

CERTIFICATE OF CORRECTION

PATENT NO. : 4,413,576

DATED : November 8, 1983

INVENTOR(S) : KAZUFUMI TAGUCHI

It is certified that error appears in the above-identified patent and that said Letters Patent is hereby corrected as shown below:

Column 1, line 14, before "rotary" insert --a--;

line 30, change "thepositions" to --the positions--.

Column 2, line 31, change "41" 2nd occurrence to --42--.

Column 3, line 21, before "as" insert --so--;

line 24, change "on" to --of--;

line 65, after "is" insert --further--;

line 66, delete "further".

Column 4, line 10, after "that" insert --within the scope of the appended claims the invention may be practiced otherwise than as specifically described herein.--;

UNITED STATES PATENT AND TRADEMARK OFFICE

CERTIFICATE OF CORRECTION

PATENT NO. : 4,413,576

DATED : November 8, 1983

INVENTOR(S) : KAZUFUMI TAGUCHI

It is certified that error appears in the above-identified patent and that said Letters Patent is hereby corrected as shown below:

Column 4, line 65, change "Claim 4" to --Claim 1--.

Column 5, line 3, change "claim 1" to --claim 5--.

Signed and Sealed this

*Sixth* Day of *August 1985*

[SEAL]

*Attest:*

DONALD J. QUIGG

*Attesting Officer*

*Acting Commissioner of Patents and Trademarks*